United States Patent [19]

Hentschel

[11] Patent Number: 4,568,202

[45] Date of Patent: Feb. 4, 1986

[54] BEARING ARRANGEMENT FOR A BORING HEAD OF A TUNNELING MACHINE

[75] Inventor: Volker Hentschel, Dorsten, Fed. Rep. of Germany

[73] Assignee: Hochtief Ag Vorm. Gebr. Helfmann, Essen, Fed. Rep. of Germany

[21] Appl. No.: 713,462

[22] Filed: Mar. 19, 1985

[30] Foreign Application Priority Data

Mar. 20, 1984 [DE] Fed. Rep. of Germany ..... 3410113

[51] Int. Cl.[4] ..... F16C 23/02

[52] U.S. Cl. ..... 384/99; 384/247

[58] Field of Search ..... 384/99, 274, 257, 253, 384/252, 260, 247

[56] References Cited

U.S. PATENT DOCUMENTS

| | | | |
|---|---|---|---|
| 1,602,288 | 10/1926 | Stovall | 384/257 |
| 3,679,272 | 7/1972 | Costa et al. | 384/99 |
| 3,760,720 | 9/1973 | Marshall | 384/99 |

*Primary Examiner*—Lenard A. Footland

*Attorney, Agent, or Firm*—Karl F. Ross; Herbert Dubno

[57] ABSTRACT

A bearing assembly for the shaft of a boring head for an excavating machine comprises four piston-and-cylinder units bridged between the bearing and a support ring and pivotally connected thereto, the units lying along sides of an imaginary parallelogram of adjustable and inclined angle and side length.

6 Claims, 2 Drawing Figures

BEARING ARRANGEMENT FOR A BORING HEAD OF A TUNNELING MACHINE

FIELD OF THE INVENTION

My present invention relates to a bearing arrangement for a boring head of a tunneling machine and, more particularly, for a bearing assembly capable of journaling the shaft of such a tunneling head so that at least limited movement of the shaft perpendicular to the shaft axis is possible.

BACKGROUND OF THE INVENTION

In tunneling machines it is advantageous to provide at least one adjustable bearing assembly through which the shaft of the boring head passes and in which this shaft is journaled, this assembly frequently being referred to as a large or massive bearing and which is constructed so as to enable the shaft to be shifted in a direction transverse to the shaft axis, i.e. in a selected radial direction.

In such machines, a bracing system is generally provided from which the boring head is advanced into the rock or other subterranean face and a bearing arrangement which allows shifting in a direction perpendicular to the shaft axis permits the tunnel or a bore to be advanced somewhat eccentrically with respect to the bracing structure.

In the past, the hydraulic piston-and-cylinder arrangements which have been provided for such adjustable bearing assemblies have comprised three piston-and-cylinder units including two vertical units and a third unit located below and between the first two units to provide a radial displacement.

The three piston-and-cylinder units and their radial points of attack are also subjected to the reaction forces and both the vertical cylinder units and the lower cylinder unit must be dimensioned to take up horizontal force components.

A significant problem with such systems is that the establishment of a given degree of eccentricity with this arrangement cannot be limited to a selective operation of the cylinder since any movement to an eccentric point requires compensation of the contraction or extension of each cylinder unit and thus some displacement of fluid from each. In general, therefore the displacement is kinematically indeterminate.

If the hydraulic back pressure is not sufficient to resist the compensatory flow, the position setting may be undefined.

As a result, prior art three-point adjustment arrangements of this type have not proved to be fully satisfactory.

OBJECTS OF THE INVENTION

It is the principal object of the present invention to provide an improved shiftable bearing assembly for the purposes described in which the position of the shaft can be established with precision.

Another object of this invention is to provide an improved bearing assembly for tunnel excavating machines which has a simpler construction than those described previously but which nevertheless has more clear-cut definitions of the kinematic relationships of the position axis of the shaft as referred to the energization of the respective cylinders.

Yet another object is to provide an improved arrangement for shifting the bearing head of a tunnel or gallery-forming machine in a selected manner perpendicular to the axis of the shaft carrying the head.

SUMMARY OF THE INVENTION

These objects and others which will become apparent hereinafter are attained in accordance with the present invention in a tunneling machine provided with a cutting or boring head mounted on a head shaft which is provided with a support and which is journaled in this support in a large or massive bearing comprising inner and outer bearing members interconnected by four hydraulic piston-and-cylinder units, each pivotally connected at its opposite ends to the two members and arrayed in a common plane in a parallelogram, albeit with adjustable angles and side lengths.

The units forming the opposite sides of the parallelogram are hydraulically connected in pairs so that, by varying the effective length or stroke of one pair of units, the other two units which are generally transverse in orientation to the first-mentioned pair of units can function as rigid links pivotally connected between the inner and outer members, thereby effecting a displacement of the boring head and the shaft in a direction perpendicular to its axis in a kinematically defined relationship because of the practically rigid links coupling the two members during this movement. This eliminates the need for synchronizing the flows between the units which are hydraulically actuated in one or the other direction and also precludes any need for compensatorily adjusting the hydraulic flow of the piston-and-cylinder units of the other pair.

At the end of the displacement stroke the pair of cylinder units which were operative can be blocked so that the linkage is formed between the inner and outer members which is fully force-transmitting in all directions.

If the hydraulic pressure is sufficient to overcome the bearing reaction force during boring, the eccentricity can be adjusted even during the boring operation and hence the direction of excavation can be controlled.

Each pair of piston-and-cylinder units can be provided with a common pair of hydraulic feed and drain lines according to a feature of the invention and it has been found to be advantageous to have the cylinders and the pistons respectively of each pair connected to the same members and thus located on the same side.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 2:
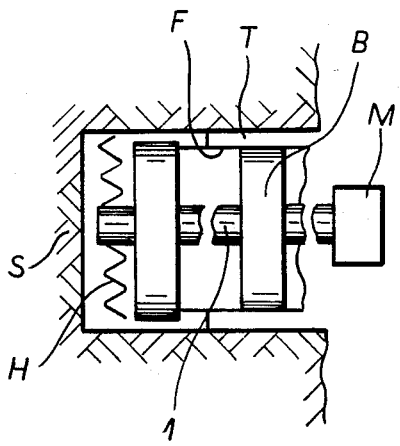
FIG. 2 is a section through a tunnel being cut in subterranean structure illustrating a portion of such a machine.

In my copending applications, Ser. No. 673,795 of Nov. 21, 1984 and Ser. No. 674,895 of Nov. 26, 1984, I have described principles of tunnel excavation in which, as illustrated in FIG. 2, a tunnel T is excavated in a subterranean structure S by an excavating head or boring head H which can be rotatably mounted on a shaft 1. As the tunnel is advanced, shields F are positioned in the tunnel and the space between these shields and the excavated wall is filled with concrete. The shield can then be removed.

Figure 1:
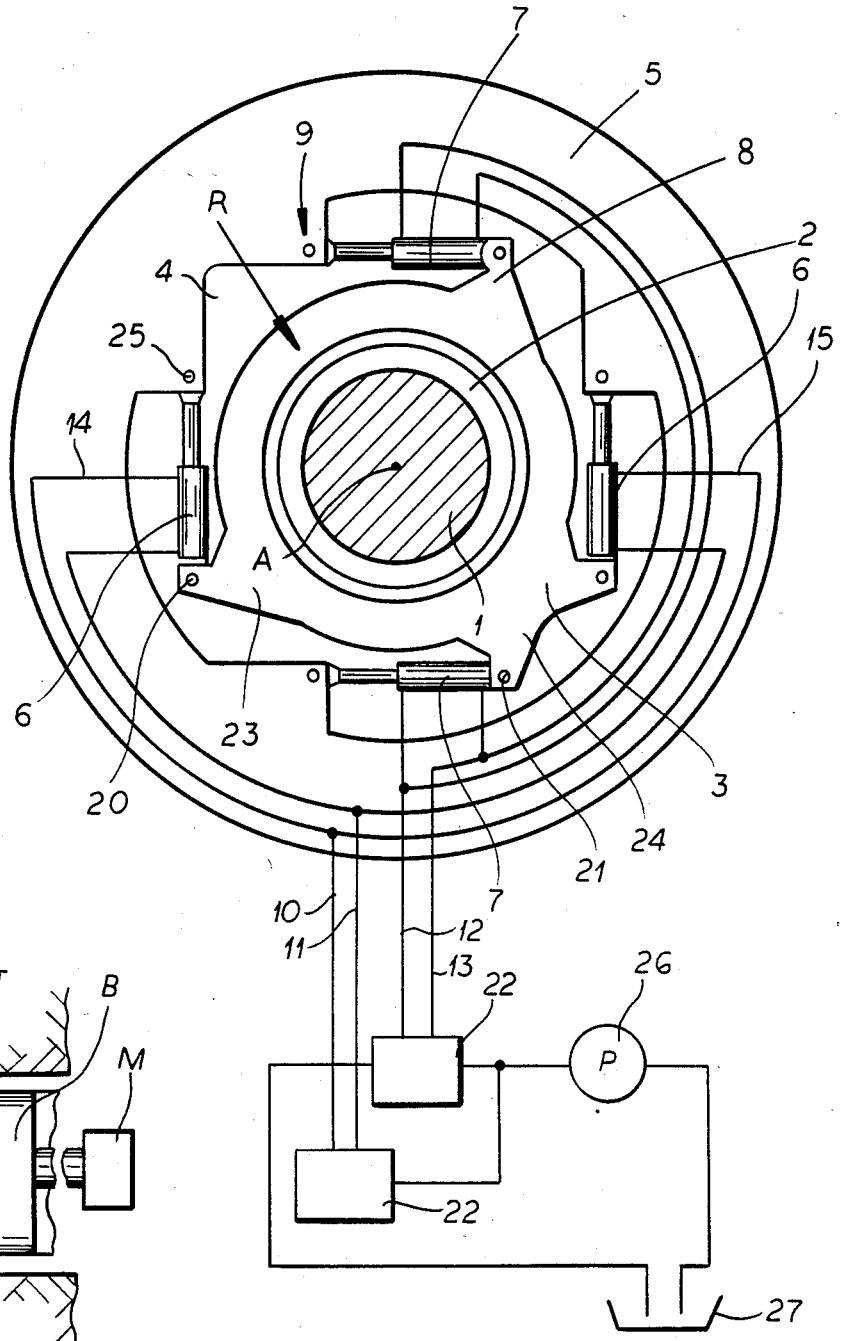
FIG. 1 is an elevational view taken in section through the main shaft, diagrammatically showing a massive bearing assembly for the shaft of a boring head of a tunnel excavating machine.

To allow the head to be advanced, a bracing structure B is provided and the shaft 1 can be journaled in this present structure by a massive bearing assembly represented in FIG. 1, a motor M, e.g. a hydraulic motor, rotating the shaft. These elements of the tunneling machine have all been illustrated highly diagrammatically since their organization does not itself form part of the invention but rather is provided to show that within the support B, the bearing assembly of FIG. 1 can allow the axis A of the shaft to be shifted in a direction perpendicular to this axis to bring about a certain eccentricity of the advance of the head with respect to the bracing structure B.

The massive bearing R whose support 5 can be anchored in the bearing structure, comprises an inner ring 2 which can be affixed to the shaft 1 and which is journaled via rollers or the like in an outer ring 3.

The outer ring 3 is received with clearance at 4 within the support 5 and is connected thereto by four double-acting hydraulic piston-and-cylinder units 6,7, provided in pairs, within this clearance.

The cylinder units 6 and 7 all have their cylinder sides pivotally connected, e.g. at 20 and 21 to projections 23 and 24 of the outer ring 3.

The piston sides of these units are each pivotally connected at 25 to projections 9 extending inwardly from the support 5. The axes of the pivots are all parallel to the axis A of the shaft.

In FIG. 1 the bearing arrangement is shown in its base or neutral position and in this position, the cylinder units 6 and 7 lie along sides of an imaginary square, i.e. two of these units (6) are disposed vertically and two of these units (7) are disposed horizontally.

The pair of units 6 are connected to a common pair of hydraulic supply and return lines 10 and 11 while the horizontal pair of units 7 are connected to a common pair of hydraulic supply and return lines 12 and 13 so that both cylinder units of a given pair can be simultaneously supplied in one or the other direction with hydraulic fluid.

For hydraulically actuating these units, respective valves 22 are provided, the valves 22 being connected to a pump 26 drawing fluid from a reservoir 27. The hydraulic lines 14 and 15 connect corresponding ports of the double-acting cylinder cylinder units of each pair with a corresponding supply and return line, e.g. the line 10 seen in FIG. 1.

Assuming the valve 22 is blocked so that members 7 act as rigid links, operation of valve 22 can extend the cylinder unit 6 to shift the axis A downwardly and to the right with respect to the support.

Conversely with the valve for cylinder 6 blocked, these units act as rigid links and hydraulic cylinders 7 can be contracted to draw the axis of the shaft to the left.

All other shifting possibilities can be contemplated as well and in each case the displacement of the shaft axis perpendicular to itself follows a well-defined kinematic path because of the pair of cylinders acting as rigid links As can be stated otherwise, when the units 6 are actuated, since the lengths of the units 7 do not change, the support assembly is rotated in the clockwise sense and the boring head is shifted eccentrically to the left.

I claim:

1. A bearing assembly for a shaft of a boring head of a tunnel-excavating machine, comprising:

a support;

a shaft bearing disposed in said support with clearance and carrying said shaft;

four piston-and-cylinder units interconnecting said support and said bearing and articulated at opposite ends to said support and said bearing, said units being provided in parallel pairs; and means for hydraulically supplying the units of each pair independently of the other whereby the units of a pair supplied with hydraulic fluid are supplied with the hydraulic fluid at the same time, in the same direction so as to operate the units of the supplied pair with the same stroke.

2. The assembly defined in claim 1 wherein a pair of hydraulic lines is connected to corresponding ports of each of the units of a respective pair.

3. The assembly defined in claim 2 wherein cylinders of the respective units of each pair are provided on the same side with respect to connection to one of said supports and said bearing.

4. The assembly defined in claim 3 wherein said bearing comprises an inner bearing race receiving said shaft and an outer bearing race receiving said inner bearing race, said outer bearing race being provided with four outwardly extending projections, cylinders of said units each being connected pivotally to a respective one of said projections.

5. The assembly defined in claim 4 wherein said support is a ring having inwardly extending abutments each pivotally connected to one piston of a respective one of said units.

6. The assembly defined in claim 5 wherein said units lie along sides of an imaginary square in a neutral position of the shaft.

* * * * *